US010639777B2

(12) United States Patent
Stauss-Reiner et al.

(10) Patent No.: US 10,639,777 B2
(45) Date of Patent: May 5, 2020

(54) DRIVE-IN DEVICE HAVING AN ADJUSTABLE COMBUSTION CHAMBER

(71) Applicant: HILTI AKTIENGESELLSCHAFT, Schaan (LI)

(72) Inventors: Peter Stauss-Reiner, Feldkirch (AT); Norbert Heeb, Buchs (CH); Thomas Sperrfechter, Grüsch (CH); Markus Woerner, Hergensweiler (DE); Tilo Dittrich, Feldkirch (AT)

(73) Assignee: HILTI AKTIENGESELLSCHAFT, Schaan (LI)

( * ) Notice: Subject to any disclaimer, the term of this patent is extended or adjusted under 35 U.S.C. 154(b) by 400 days.

(21) Appl. No.: 15/535,612

(22) PCT Filed: Dec. 16, 2015

(86) PCT No.: PCT/EP2015/079958

§ 371 (c)(1),
(2) Date: Jun. 13, 2017

(87) PCT Pub. No.: WO2016/096962

PCT Pub. Date: Jun. 23, 2016

(65) Prior Publication Data

US 2017/0341210 A1 Nov. 30, 2017

(30) Foreign Application Priority Data

Dec. 19, 2014 (EP) ..... 14199197

(51) Int. Cl.
*B25C 1/08* (2006.01)
*B25C 1/00* (2006.01)

(52) U.S. Cl.
CPC ..... *B25C 1/08* (2013.01); *B25C 1/008* (2013.01)

(58) Field of Classification Search
CPC ..... B25C 1/04; B25C 1/08; B25D 9/10
(Continued)

(56) References Cited

U.S. PATENT DOCUMENTS 6,460,507 B2 * 10/2002 Thieleke ..... B25C 1/08 123/260
7,178,487 B2 * 2/2007 Zahner ..... B25C 1/08 123/46 H (Continued)

FOREIGN PATENT DOCUMENTS

DE 102 26 878 A1 12/2003
DE 10 2005 006167 A1 8/2006
EP 2 465 643 A2 6/2012

OTHER PUBLICATIONS

International Bureau, International Search Report in International Application No. PCT/EP2015/079958, dated Mar. 10, 2016.

*Primary Examiner* — Chelsea E Stinson
(74) *Attorney, Agent, or Firm* — Leydig Voit & Mayer, Ltd.

(57) ABSTRACT

The invention relates to a drive-in device, comprising a drive-in piston, guided in a cylinder, for driving a nail member into a workpiece, and a combustion chamber arranged above the drive-in piston, said combustion chamber being Tillable with a combustion gas, wherein the combustion chamber has a bottom that is adjustable along an axis, wherein the bottom has a groove that extends in the circumferential direction and has an inserted seal which bears in a radial direction against a rigid combustion-chamber wall, wherein a front surface, in the axial direction, of the seal protrudes in the direction of the axis from a terminating plane of the groove.

20 Claims, 2 Drawing Sheets

(58) Field of Classification Search
USPC ..... 227/10, 130
See application file for complete search history.

(56) References Cited

U.S. PATENT DOCUMENTS

| | | | | |
|---|---|---|---|---|
| 7,275,673 | B2 * | 10/2007 | Zahner | B25C 1/08 227/10 |
| 2003/0230620 | A1 | 12/2003 | Fielitz | |
| 2005/0279802 | A1 | 12/2005 | Moeller | |
| 2006/0175374 | A1 | 8/2006 | Zahner et al. | |
| 2012/0061445 | A1 * | 3/2012 | Liu | B25C 1/042 227/130 |
| 2012/0153002 | A1 * | 6/2012 | Dittrich | B25C 1/08 227/10 |
| 2013/0206811 | A1 * | 8/2013 | Zhao | B25C 1/041 227/130 |
| 2019/0047129 | A1 * | 2/2019 | Sperrfechter | B25C 1/08 |

* cited by examiner

DRIVE-IN DEVICE HAVING AN ADJUSTABLE COMBUSTION CHAMBER

CROSS-REFERENCE TO RELATED APPLICATIONS

This patent application is the U.S. National Stage of International Application No. PCT/EP2015/079958, filed Dec. 16, 2015, which claims the benefit of European Application No. 14199197.6, filed Dec. 19, 2014, which are each incorporated by reference.

BACKGROUND OF THE INVENTION

The present invention relates to a drive-in tool, in particular, a hand-held drive-in tool, according to the preamble of claim 1.

DE 102 26 878 A1 describes a drive-in tool for driving a nail into a workpiece, with which a combustion chamber is charged with a combustion gas, wherein a drive-in piston is accelerated against the nail after an ignition process. The combustion chamber has an adjustable combustion chamber bottom, wherein an adjusting rod is fed by means of a leadthrough through a housing of the combustion chamber and is connected to the adjustable combustion chamber bottom. The combustion chamber bottom is sealed off against the combustion chamber wall by a continuous seal.

BRIEF SUMMARY OF THE INVENTION

The present invention addresses the problem of setting forth a drive-in tool that enables especially reliable operation even at low ambient temperatures.

This problem is solved, for an aforementioned drive-in tool, according to the present invention with the characterizing features of claim 1. The axial projecting distance or the projection of the seal from the terminating plane of the groove effectively strips off water adhering to the combustion chamber wall when the bottom is being adjusted, without excessive intrusion into the groove. In particular, this prevents water from freezing in the groove region at temperatures below the freezing point.

The bottom of the combustion chamber, which is adjustable relative to the combustion chamber wall, makes it possible for the combustion chamber to be collapsed, for example, as part of a safety device if the tool has not been properly placed on a workpiece. With such tools, the combustion chamber is tensioned by placement before each setting process, so that in each case a slipping over of the combustion chamber wall takes place.

In a generally preferred embodiment of the present invention, the front surface of the seal protrudes in the direction of the axis over a terminating plane of the bottom. This allows for especially effective drainage of the wiped-off water past the gap between the bottom and the combustion chamber wall.

It is generally advantageous for drainage of the wiped-off water to be supported by a radially inner end of the front surface having a sharp-edged termination. Preferably, the sharp-edged termination has an edge having an angle between 30° and 120°, particularly preferably between 70° and 110°. Such an edge forms a barrier for the wiped-off water, which is scarcely able to penetrate herethrough around the edge into the gap between the bottom and combustion chamber.

To further improve the drainage of the water, a recess for discharging water that has been wiped off through the seal is arranged on the combustion chamber bottom and/or in the region of the combustion chamber wall. This makes it also possible to discharge greater amounts of water that has condensed on the combustion chamber wall.

Generally advantageously, the seal protrudes on both sides over the terminating plane of the groove so as to prevent penetration of water into the gap in both axial movement directions of the bottom. In simple embodiments, the seal may be shaped, in particular, symmetrically.

In an especially preferred embodiment of the present invention, the seal comprises a sealing ring that is open in the circumferential direction. This makes it possible for even sealing rings of dimensionally rigid material to be inserted into the groove. Generally preferably, the sealing ring is then composed of a hard sealant. A hard sealant is to be understood here to be a material that is not elastically deformed—or not visibly elastically deformed—in the sealing state. Such a material may be, for example, a metal such as steel, copper, or aluminum, or a hard, in particular, fiber-reinforced plastic. For this purpose, a distinction should be made from sealing materials such as rubber or silicone that are deformed when used as a seal in order to achieve a sufficient sealing effect.

In the interest of a high sealing effect, at least two sealing rings arranged successively in the axial direction are provided. Especially preferably, both sealing rings are inserted into the groove so as to achieve a low structural height. Open abutments of the sealing rings may then be oriented at an offset to one another in the circumferential direction, in order to ensure favorable tightness even at high pressures.

To improve the sealing effect, it is then preferably provided that an elastic support member is arranged under the sealing ring. Such a support member may be, in particular, a circumferential ring composed of an elastic material that is inserted into the groove, e.g., one that is made of an elastomer or a spring plate. The support member may, instead of a circumferential ring, also be composed of a plurality of individual elastic members.

A preferred embodiment of the drive-in tool has a housing to which the combustion chamber wall is rigidly connected. The bottom then constitutes a moving part in the drive-in tool. An alternative embodiment of the drive-in tool has a housing to which the bottom is rigidly connected. The combustion chamber wall then constitutes a moving part in the drive-in tool.

Preferably, the bottom is adjustable relative to the combustion chamber wall to such an extent as to form an inlet and/or outlet opening of the combustion chamber for air and/or fuel between the bottom and the combustion chamber wall. Especially preferably, the bottom and the combustion chamber wall form an inlet and/or outlet valve of the combustion chamber.

Other advantages and features of the present invention shall be apparent from the following description of an embodiment and from the dependent claims.

A preferred embodiment of the present invention shall be described hereinbelow and set forth in greater detail with reference to the accompanying drawings.

BRIEF DESCRIPTION OF THE SEVERAL VIEWS OF THE DRAWING(S)

DETAILED DESCRIPTION OF THE INVENTION

Figure 1:
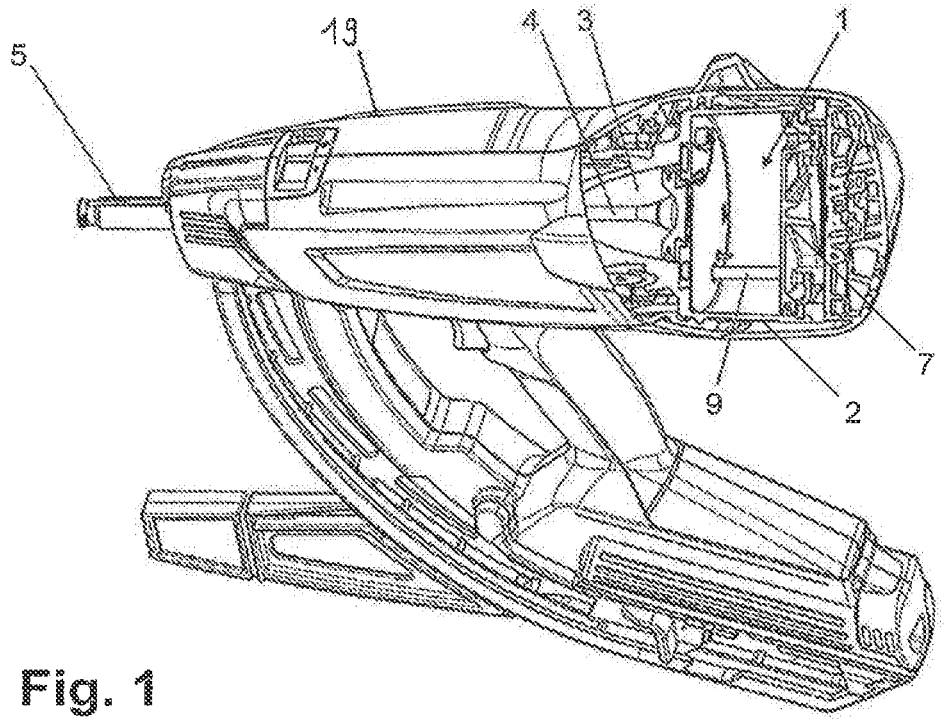
FIG. 1 illustrates a spatial overview of a drive-in tool according to the present invention, with a sliced combustion chamber.

The drive-in tool from FIG. 1 is a hand-held tool, comprising a housing 19 and a combustion chamber 1 having a combustion chamber wall 2 that is cylindrical in some sections and is rigidly connected to the housing 19. A cylinder 3 having a drive-in piston 4 guided therein is adjacent to the combustion chamber 1. A safety mechanism of the tool comprises an attachment sheath 5 that is placed on a workpiece (not shown) and is pressed against the pressure of a spring 6. Only in this state can a drive-in operation be triggered by ignition of a combustion gas in the combustion chamber. Also arranged in the combustion chamber 1 is a swirler plate 6 that can be moved prior to ignition through the combustion chamber 1.

Figure 2:
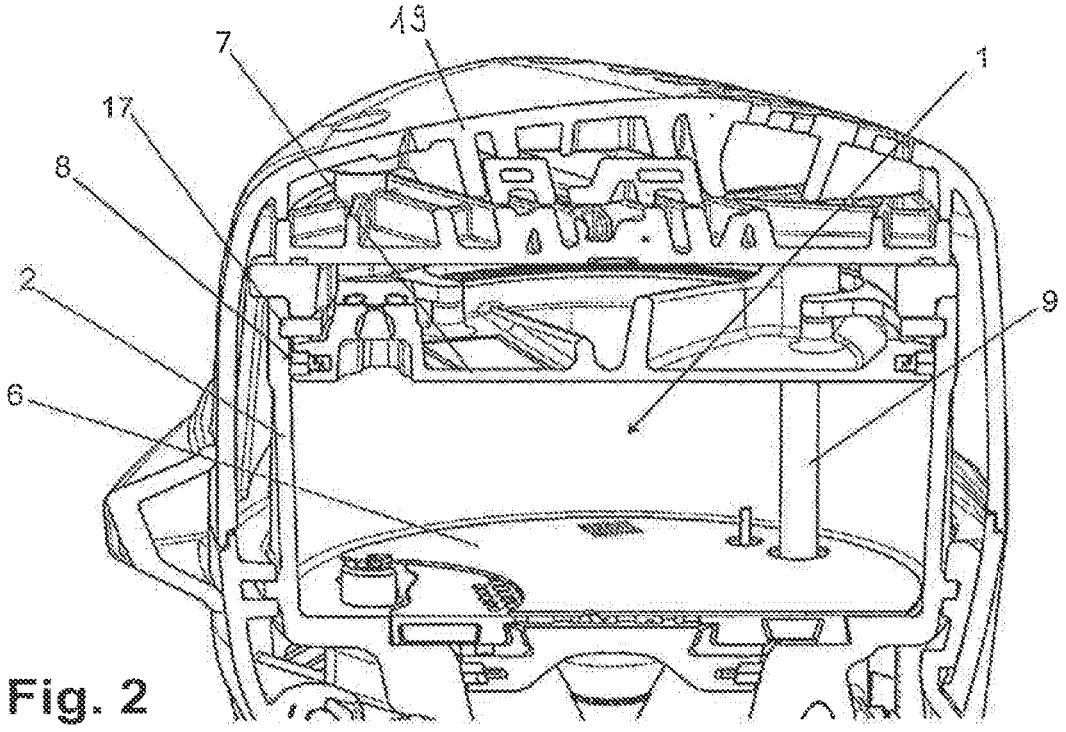
FIG. 2 illustrates an enlargement of the combustion chamber from FIG. 1.
Figure 3:
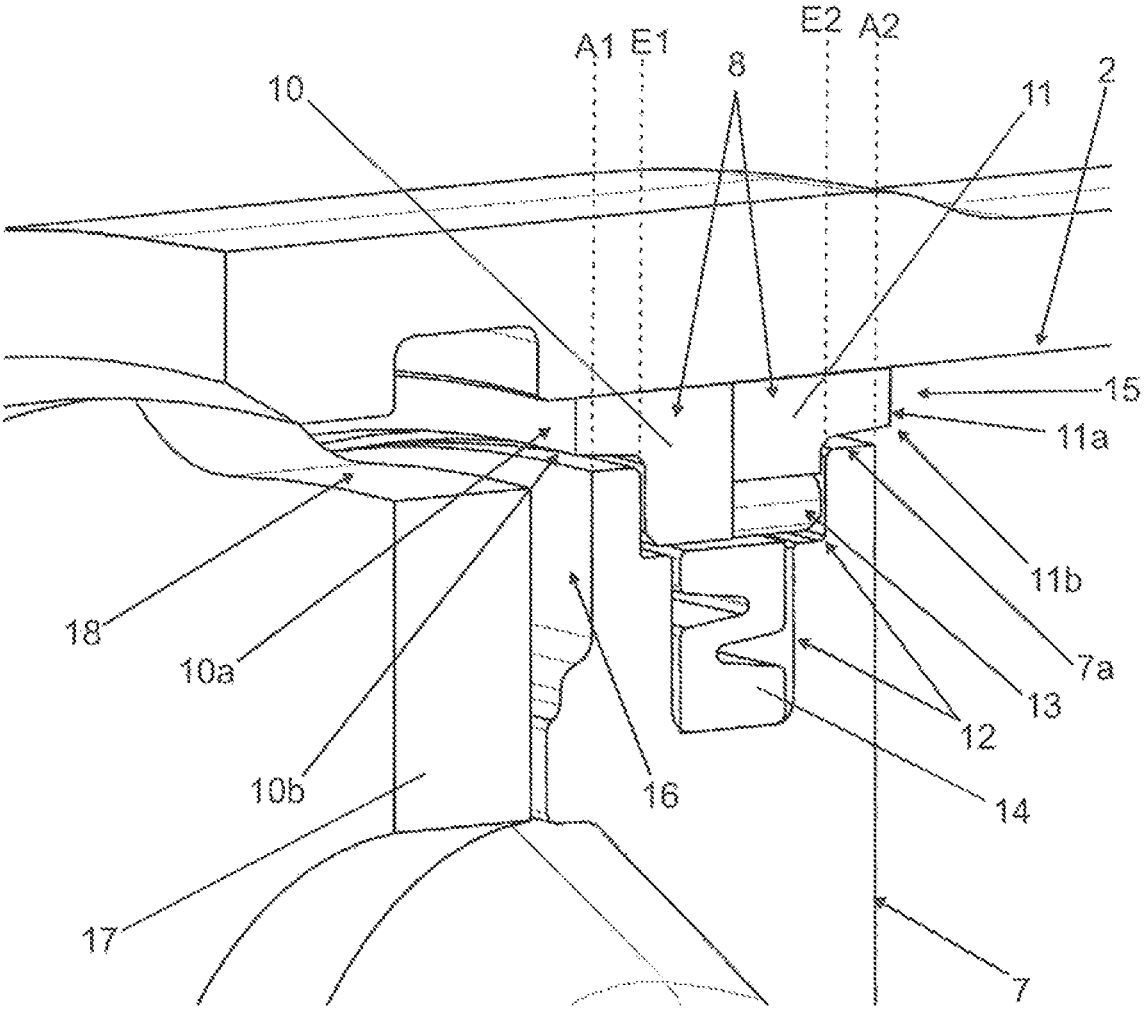
FIG. 3 illustrates a spatial sectional view of an adjustable bottom of the combustion chamber from FIG. 1, in the region of a seal.

A bottom 7 of the combustion chamber 1 can be moved along an axis coinciding with the drive-in direction, such that the volume of the combustion chamber is variable. The bottom 7 is sealed off for this purpose with a circumferential seal 8 from the cylindrical combustion chamber wall 2. The seal 8 is depicted only schematically in FIGS. 1 and 2. A detailed design of the seal 8 according to the present invention is illustrated in detail only in FIG. 3.

In embodiments that are not shown, the bottom is rigidly connected to the housing, and the combustion chamber wall is configured as an axially movable sheath. In embodiments that also are not shown, the combustion chamber wall is adjustable relative to the bottom to such an extent as to form an inlet and/or outlet opening of the combustion chamber for air and/or fuel between the bottom and the combustion chamber wall.

The bottom 7 can be moved via an adjusting rod 9 in the direction of the axis, wherein the adjusting rod 9 penetrates through a leadthrough in a front second bottom of the combustion chamber. The pressing of the attachment sheath 5 first tensions a spring and acts on the adjusting rod 9, which in turn displaces the bottom 7. This first tensions a volume of the combustion chamber that is sufficient for an ignition. Upon this movement of the bottom along the combustion chamber wall, regularly condensed water is wiped off. To prevent stiffness of the mechanism, as little water as possible should penetrate into the region of the seal 8 and freeze. For this purpose, the bottom 7, the combustion chamber 1, and the seal 8 have special embodiments that shall be described hereinbelow.

The seal 8 is configured as a set of two sealing rings 10, 11 lying directly against one another in the axial direction. Both sealing rings 10, 11 are accommodated in the same groove 12 on an outer circumferential wall 7*a* of the bottom 7. The sealing rings 10, 11 are composed of a hard material, in this case steel. The sealing rings 10, 11 each have an open abutment 13, in order to be able to be inserted into the groove 12. The abutment also allows for a defined pressing of the sealing rings against the combustion chamber wall. For this purpose, an elastic support member 14 in the groove is arranged below the sealing rings. When the sealing rings 10, 11 have been inserted, the support member 14 is pressed in in the radial direction, and resiliently subjected to force. The abutments 13 of the sealing rings 10, 11 are oriented at an offset to one another in the circumferential direction. In the depiction according to FIG. 3, the abutment 13 of the front sealing ring 11 is in the cut plane and is therefore visible.

The sealing rings 10, 11 have in this case each an L-shaped cross-section and are arranged with mirror symmetry to a midplane of the groove. In particular, the sealing rings 10, 11 may be formed as identical components. One leg of each L-shaped cross-section engages with the groove 12. The other leg extends in the axial direction in the gap 15 between the circumferential wall 7*a* of the bottom 7 and the combustion chamber wall 2. A respective front surface 10*a*, 11*a* of the sealing rings 10, 11 that is to the front in the axial direction protrudes in each case in front of a terminating plane E1, E2 of the groove 12. In particular, the front surface 10*a*, 11*a* protrudes in the axial direction also in front of a respective terminating plane A1, A2 of the bottom 2. A respective radially inner end of the front surfaces 10*a*, 11*a* has a sharp-edged termination 10*b*, 11*b* in the form of an edge having an angle of 90°. The edge lies then in each case in front of the terminating plane A1, A2 of the bottom 2. A radius of curvature of the edge is preferably less than 0.5 mm, in particular, less than 0.2 mm.

In order to better discharge the water wiped off by the movement of the bottom, and prevent water from building up in addition to penetration into the gap 15, a recess 16 is provided on the bottom 7. The recess 16 is formed as an annular space that remains between the bottom 7 and a stop ring 17. When the combustion chamber is fully expanded, the bottom 7 is supported on the stop ring 17. Through openings 18, the wiped-off water can additionally flow past the stop ring 17 into other housing regions.

The invention claimed is:

1. A drive-in tool, comprising a drive-in piston which is guided in a cylinder for driving a nail member into a workpiece, and a combustion chamber which is arranged over the drive-in piston and which can be filled with a combustion gas, wherein the combustion chamber has a cylindrical combustion chamber wall and a bottom that is adjustable with respect to the combustion chamber wall along an axis, wherein the bottom has a groove running in a circumferential direction and having a seal in the groove that rests against the combustion chamber wall in a radial direction, the groove, having a terminating plane and the seal having a surface in an axial direction protruding over the terminating plane of the groove.

2. The drive-in tool according to claim 1, wherein the surface of the seal in the axial direction protrudes over a terminating plane of the bottom.

3. The drive-in tool according to claim 2, wherein the surface of the seal in the axial direction has a radially inner end having a sharp-edged termination.

4. The drive-in tool according to claim 2, including a recess for discharging water wiped off by the seal arranged on the combustion chamber bottom and/or in a region of the combustion chamber.

5. The drive-in tool according to claim 2, wherein the seal protrudes on both sides over the terminating plane of the groove.

6. The drive-in tool according to claim 1, wherein the surface of the seal in the axial direction has a radially inner having a sharp-edged termination.

7. The drive-in tool according to claim 6, wherein the sharp-edged termination comprises an edge having an angle between 30° and 120°.

8. The drive-in tool according to claim 6, including a recess for discharging water wiped off by the seal arranged on the combustion chamber bottom and/or in a region of the combustion chamber.

9. The drive-in tool according to claim 6, wherein the seal protrudes on both sides over the terminating plane of the groove.

10. The drive-in tool according to claim 1, including a recess for discharging water wiped off by the seal arranged on the combustion chamber bottom and/or in a region of the combustion chamber.

11. The drive-in tool according to claim 10, wherein the seal protrudes on both sides over the terminating plane of the groove.

12. The drive-in tool according to claim 1, wherein the seal protrudes on both sides over the terminating plane of the groove.

13. The drive-in tool according to claim 1, wherein the seal comprises a sealing ring that is open in the circumferential direction.

14. The drive-in tool according to claim 13, wherein the sealing ring comprises a hard sealant.

15. The drive-in tool according to claim 13, wherein the seal comprises at least two sealing rings arranged successively in the axial direction.

16. The drive in tool according to claim 15, wherein the at least two sealing rings have been inserted into the groove.

17. The drive-in tool according to claim 13, further comprising an elastic support member arranged under the sealing ring.

18. The drive-in tool according to claim 1, wherein the drive-in tool comprises a housing and the combustion chamber wall is rigidly connected to the housing.

19. The drive-in tool according to claim 1, wherein the drive-in tool comprises a housing and the bottom is connected to the housing.

20. The drive-in tool according to claim 1, wherein there is an opening in the combustion chamber between the bottom and the combustion chamber wall, and the bottom is adjustable relative to the combustion chamber wall to form an inlet and/or outlet opening of the combustion chamber between the bottom and the combustion chamber wall.

* * * * *